US005997295A

United States Patent [19]

Mattson et al.

[11] Patent Number: 5,997,295

[45] Date of Patent: Dec. 7, 1999

[54] INLET/EXHAUST STRUCTURE FOR AN OUTDOOR FURNACE

[75] Inventors: Norman E. Mattson; Colette L. Knowles, both of Racine, Wis.

[73] Assignee: Modine Manufacturing Company, Racine, Wis.

[21] Appl. No.: 09/191,481

[22] Filed: Nov. 13, 1998

[51] Int. Cl.[6] ..... F23J 11/02

[52] U.S. Cl. ..... 432/250; 126/85 B; 126/307 R

[58] Field of Search ..... 432/73, 225, 227, 432/250; 126/85 B, 307 R, 312

[56] References Cited

U.S. PATENT DOCUMENTS

| | | | |
|---|---|---|---|
| 3,636,853 | 1/1972 | Sable | 454/39 |
| 4,089,640 | 5/1978 | Overmyer et al. | 432/73 |
| 4,286,569 | 9/1981 | Bergman et al. | 126/85 B |
| 5,680,856 | 10/1997 | Van Dijk | 126/85 B |

*Primary Examiner*—Mark Paschall
*Assistant Examiner*—Gregory A. Wilson
*Attorney, Agent, or Firm*—Wood, Phillips, VanSanten, Clark & Mortimer

[57] ABSTRACT

An all weather inlet/exhaust structure (32) for an outdoor furnace (10,12,14) includes a generally rectangular upper compartment (40) having an imperforate upper wall (42) and horizontally louvered, vertical side walls (44) along with an imperforate bottom wall (46) with a generally central opening (48) therein. A lower compartment (56) in the form of an inverted truncated pyramid with its upper wall being defined by the lower wall (46) of the upper compartment is provided. The lower compartment has horizontally louvered, sloped, inwardly directed side walls (58) terminating in an open bottom (60) of smaller size than the first compartment lower wall (46). A generally rectangular inlet air duct (66) depends from the lower edges of the lower compartment side walls (58) and an exhaust duct (26) is disposed within the inlet air duct (66) and extends upwardly through the lower compartment (56) to the generally central opening (48) and the bottom wall (46) of the upper compartment (40).

12 Claims, 3 Drawing Sheets

FIG. 3
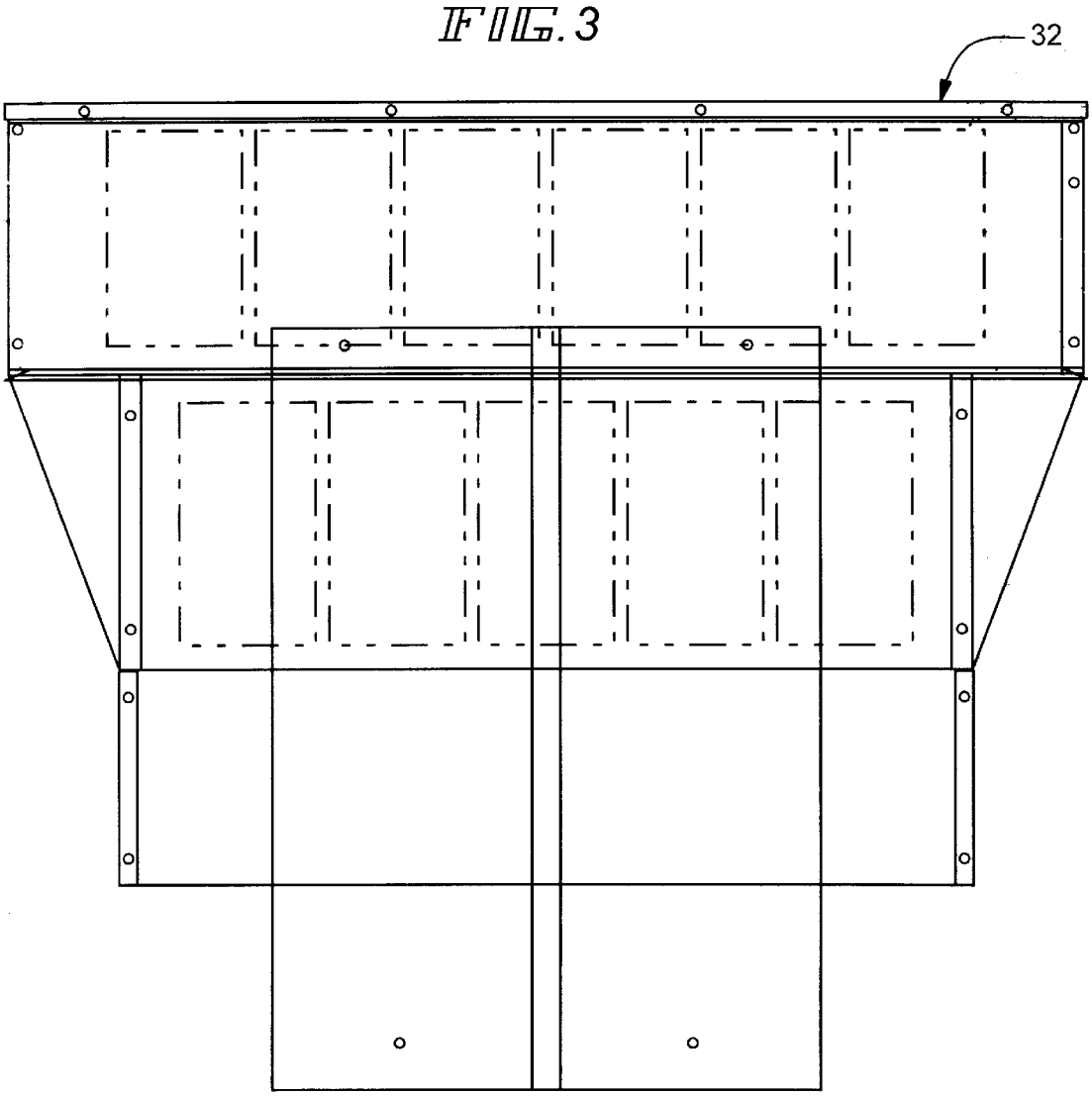
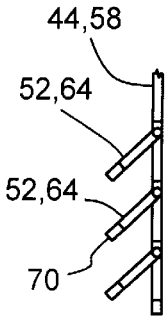
FIG. 4

INLET/EXHAUST STRUCTURE FOR AN OUTDOOR FURNACE

FIELD OF THE INVENTION

This invention relates to an inlet/exhaust structure for use with fuel-consuming furnaces that are intended to be located in an environment wherein they are subject to the elements.

BACKGROUND OF THE INVENTION

Increasingly, the HVAC industry has resorted to locating heating, ventilating and air conditioning equipment on the exteriors of the structures which the systems are intended to service. For example, it is now commonplace, particularly in commercial installations, to mount HVAC equipment on the roof of a structure or on a pad adjacent to the structure.

The benefits of this practice are several. Perhaps the most prominent one is the fact that with exterior location of HVAC equipment, valuable interior floor space within a building which would normally be used to house the HVAC equipment is freed for other usages. Furthermore, because developers tend to conserve the interior space devoted to HVAC equipment, oftentimes internally mounted HVAC equipment is located in cramped quarters, making it difficult to service. This problem is overcome by mounting the HVAC equipment on the exterior of the structure to be serviced by such equipment, making access to it for servicing a much simpler job.

One difficultly encountered in mounting HVAC equipment on the exterior of a structure that it is to service resides in the possible ingestion into the system of foreign substances found in the ambient. For example, ingestion of rainwater may result in corrosion problems in the equipment. In some types of operations, ingestion of rainwater may also cause operational difficulty in operating the HVAC system.

In HVAC equipment such as furnaces which burn a combustible fuel, another difficulty presents itself. Furnaces typically have two ports to their surroundings. One port serves as an inlet for combustion air while the other port serves as an outlet for the products of combustion resulting from the fuel consumed by the furnace. Not untypically, such ports are located in spaced relation to one another to prevent products of combustion from being drawn into the inlet for the combustion air which, by reason of their composition, could reduce the oxygen content of the inlet combustion air stream and thereby affect the combustion process. At the same time, when the combustion air inlet and the exhaust outlet are located in substantially spaced relationship, difficulties associated with a difference in pressure at the two ports may deleteriously affect the combustion process. For example, exteriorly mounted units are exposed to the wind. Wind currents are not necessarily uniform at two spaced locations, particularly in urban areas where the presence of buildings or other structures may cause swirling winds to occur.

As a result, if the wind causes the pressure at the exhaust outlet to be greater than that at the combustion air inlet, there will be back flow of combustion gas toward the combustion chamber of the furnace. This may cause choking of the combustion process within the furnace which, in turn, can result in unconsumed hydrocarbon fuel ultimately being discharged to the ambient. Similarly, if the wind causes the pressure at the combustion air inlet to exceed that at the exhaust outlet, the resulting rush of air through the combustion chamber may cause partial or entire extinguishing of the flame within the combustion chamber. This, also, results in the discharge of unconsumed fuel to the ambient. Either occurrence will also affect the efficiency of the furnace and thereby interfere with the ability of the equipment to perform its intended, function within the HVAC system.

The present invention is directed to overcoming one or more of the above problems.

SUMMARY OF THE INVENTION

It is the principal object of the invention to provide a new and improved inlet/exhaust structure for use with furnaces or heaters intended for outdoor operation. More particularly, it is an object of the invention to provide a new and improved inlet/exhaust structure that minimizes the possibility of the entry of unwanted material, as, for example, rainwater, into the system, and which simultaneously avoids inefficiencies and problems associated with a pressure differential across the combustion air inlet and the combustion gas outlet.

An exemplary embodiment of the invention achieves the foregoing object in a heater or furnace intended for installation in an outdoor area and having a housing with a combustion zone within the housing for burning fuel and generating gases of combustion. A plenum is located within the housing and has a heat exchanger for receiving the gases of combustion and an air space for receiving air to be heated. A combustion gas discharge port is provided in the plenum. The plenum is spaced from the housing to define a combustion air receiving space. Ports are located in the housing and include an exhaust port connected to the gas discharge port and an inlet port in fluid communication with the combustion air receiving space. The invention contemplates an improved inlet/exhaust structure which is mounted on the housing and has an upper compartment separated from a lower compartment by a partition. A first conduit is connected to the exhaust portion and extends through the lower compartment and the partition to this upper compartment. A second conduit extends from the air inlet to the lower compartment. The lower compartment has a side wall extending downwardly and inwardly and vents are located in the side walls.

As a consequence of this construction, the exhaust outlet located just above the combustion air inlet to avoid the existence of any appreciable pressure differential between the two. Moreover, the use of downwardly and inwardly extending side walls on the lower compartment into which combustion air enters through the vents therein provides a means whereby the vents are not directly exposed to, for example, falling rain to prevent the entry of rain into the system.

In a preferred embodiment, the ports are generally concentric with the exhaust port being within the air inlet port. The first conduit is located within the second conduit.

According to one embodiment of the invention, the vents include a series of generally horizontally extending louvers. In a highly preferred embodiment, the louvers have lower free edges extending outwardly and away from the side wall.

In one embodiment of the invention, the lower compartment is shaped as an inverted, truncated pyramid.

In a highly preferred embodiment of the invention the first conduit is cylindrical in cross section and the second conduit is polygonal in cross section.

In a best mode of the invention, the inlet/exhaust structure includes a generally rectangular upper compartment having an imperforate upper wall, horizontally louvered side walls, and an imperforate bottom wall with a generally central opening therein. A lower compartment is provided in the form of an inverted truncated pyramid with its upper wall being defined by the first compartment lower wall. The lower compartment has horizontally louvered, sloped, inwardly directed side walls terminating in an open bottom of smaller size than the first compartment lower wall. A generally rectangular inlet air duct depends from the lower edges of the lower compartment side walls and an exhaust duct is disposed within the inlet air duct and extends upwardly through the lower compartment to the generally central opening in the partition or lower wall of the upper compartment.

In a preferred embodiment, the horizontally louvered side walls have horizontally elongated louvers with lower free edges disposed outwardly of the associated side wall.

In one embodiment, the exhaust duct is circular in cross section.

In a preferred embodiment, the lower compartment side walls are at least about 20° to the vertical.

In a highly preferred embodiment, the louvers in the lower compartment side walls are at about 45° to the associated side wall.

Other objects and advantages will become apparent from the following specification taken in connection with the accompanying drawings.

DESCRIPTION OF THE DRAWINGS

FIG. 3 is a vertical section of the inlet/exhaust structure; and

FIG. 4 is an enlarged, fragmentary view of louvers employed in the inlet/exhaust structure.

DESCRIPTION OF THE PREFERRED EMBODIMENT

Figure 1:
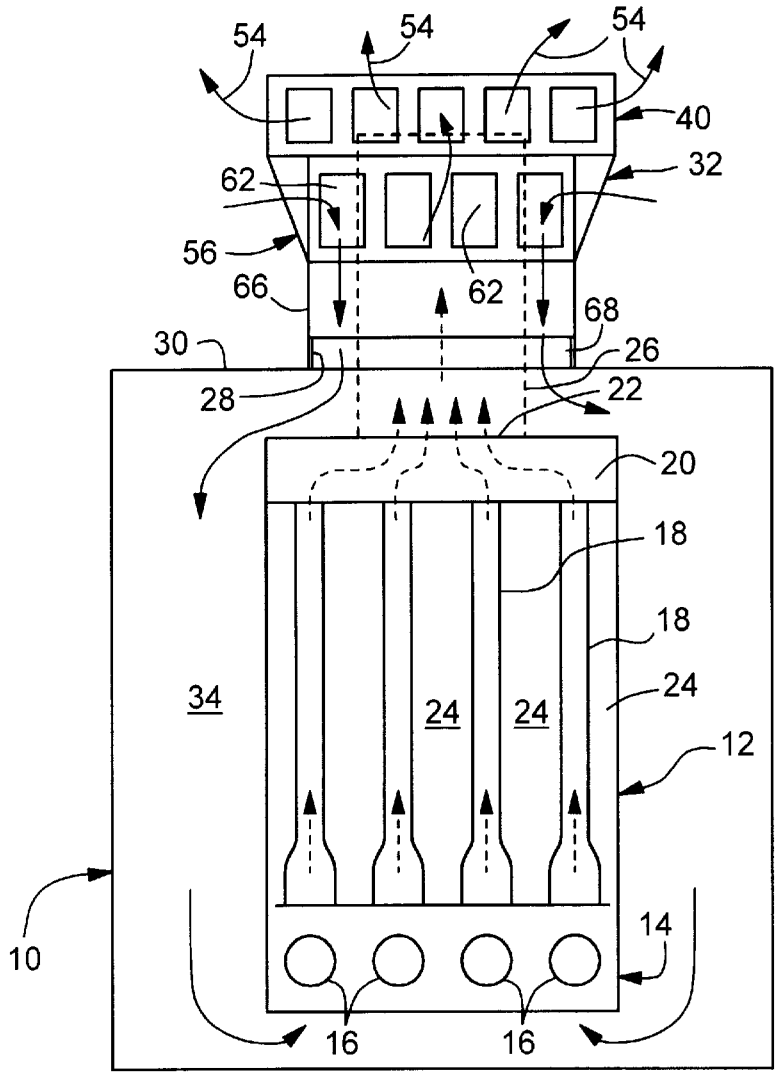
FIG. 1 is a somewhat schematic illustration of a furnace intended for location on the exterior of a building or the like and including an inlet/exhaust structure made according to the invention.

A typical furnace or heater is illustrated in FIG. 1 and is seen to include an outer housing, generally designated 10, in which a plenum, generally designated 12, is located. At the lower end of the plenum 12, a burner assembly, generally designated 14, is provided. The burner assembly 14 includes a plurality of elongated burners 16 which receive fuel such as natural gas and consume the same. Elongated burner tubes 18 are located above each of the burners 16 and receive the products of combustion and conduct them upwardly to a manifold 20 having an exhaust gas outlet opening 22. The burner tubes 18 act as a heat exchanger to exchange from the hot gases of combustion to air flowing in the spaces 24 between the adjacent tubes 18 and the walls of the plenum 12. Typically, the spaces 24 will be connected by ducting, not shown, to deliver the heated air to a point of use.

A duct 26, which may be circular in cross section, extends from the opening 22 through an opening 28 in the upper wall 30 of the housing 10 to a combined inlet/exhaust structure, generally designated 32.

It is to be particularly noted that the plenum 12 is spaced from the housing 10 to provide a combustion air space 34 which is in fluid communication with the burner 16. That is to say, combustion air from the space 34 is consumed at the burners 16 to provide the hot gases of combustion to the tubes 18. Air enters the space 34 through the opening 28 about the duct 26.

Figure 2:
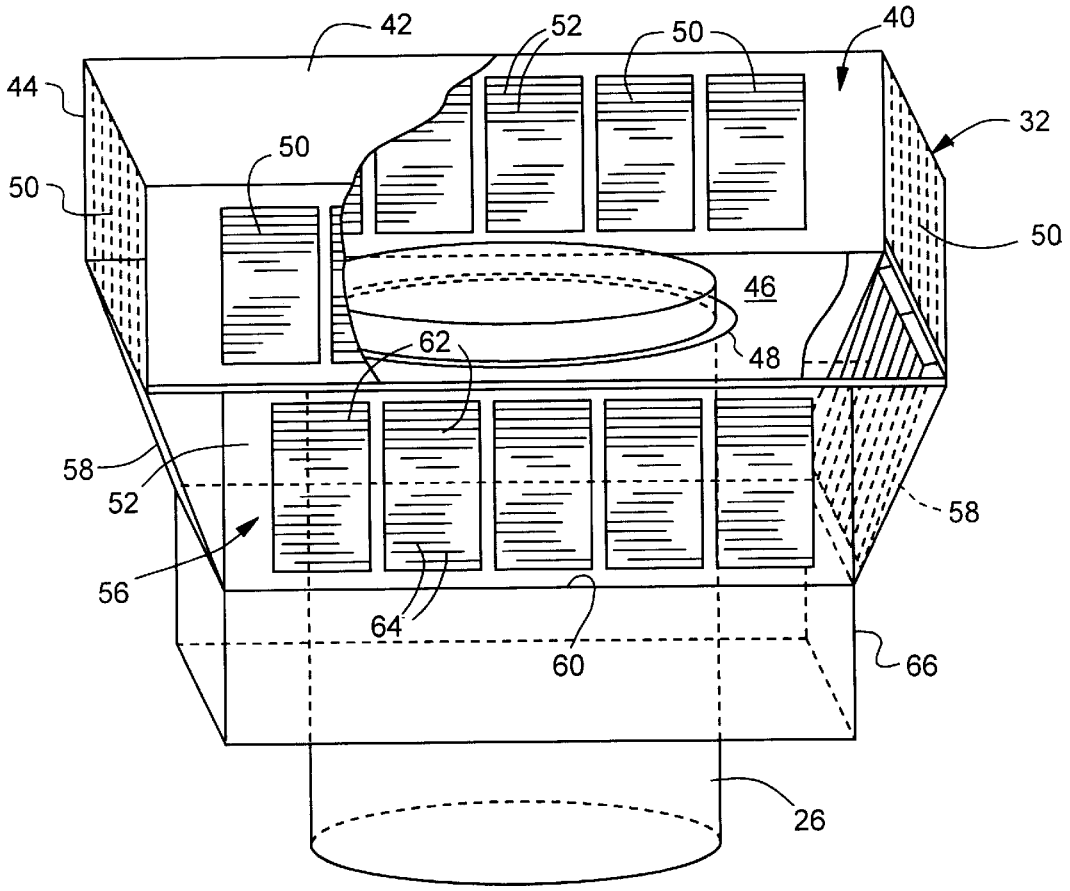
FIG. 2 is an enlarged, perspective view of the inlet/exhaust structure with parts broken away for clarity.

Turning now to FIGS. 2 and 3, the inlet/exhaust structure 32 will be described in greater detail. The inlet/exhaust structure 32 is made of three sections. A first is an upper compartment, generally designated 40. As seen in FIG. 2, the same is rectangular and includes an upper, imperforate wall 42 and depending, vertical side walls 44. The upper compartment 40 has its lower end bounded by an imperforate wall or partition 46. The lower wall 46 includes a generally central opening 48 through which the duct 26 extends in sealed relation thereto.

The side walls 44 are each provided with a series of vent openings 50, each of which is provided with horizontally elongated louvers 52 whose structure will be described in greater detail hereinafter.

As a consequence of this construction, hot gases of combustion from the burners 16, after exchanging heat with a fluid medium, such as air, as the gas passes through the heat exchanger defined by the tubes 18, flow upwardly through the duct 26 to the upper compartment 40 to exit the same through the vents 50. Because these gases will typically be at higher temperature than the ambient, they will have a lesser density than ambient air and will tend to flow upwardly from the vent openings in the direction of arrows 54 as shown in FIG. 1.

The lower wall 46 of the upper compartment 40 defines the upper wall of a lower compartment, generally designated 56. The lower compartment 56 is generally in the shape of an inverted, truncated, rectangular pyramid and thus has inwardly and downwardly sloping side walls 58. The side walls 58 terminate in an open bottom 60. Each of the side walls 58 is provided with a plurality of generally rectangular vents 62 which, like the vents 50, are provided with horizontally elongated louvers 64.

The third section of the inlet/exhaust structure 32 is simply a rectangular duct 66 which depends from the lower edges of the side walls 58 at the opening 60. It will be noted that the duct 66 contains the duct 26 and though dissimilar to the duct 26 in the geometric sense, is generally concentric with the same.

The duct 66 may be attached to an upstanding flange 68 about the opening 28 (FIG. 1) in the housing 10.

In the usual case, the angle between the side walls 58 arid a vertical plane will be at least about 20°. As a result, because of the fact that the opening 60 is of smaller size than the wall 46, the upper compartment 40 serves like eaves to prevent direct access to the vents 62 in the side walls. Further, the fact that the side walls 58 slope inwardly and downwardly prevents the walls from being contacted by falling rain unless the rain is being blown in a direction with a vertical component of more than 20°. In this case, the louvers 64 serve to additionally prevent the rain from reaching the vent opening 62.

A preferred form of the louvers 52,64 is illustrated in FIG. 4. The side wall 44,58 has louvers 52,64 stamped therein, preferably about three to an inch. The louvers 52,64 have lower free edges 70 which are directed outwardly, downwardly and away from the corresponding side wall 44,58 as shown in FIG. 4. Preferably, the louvers 52,64 are at an angle of about 45° to the associated side wall 44,58.

As an alternative, the louvers could extend into the associated compartment and upwardly at approximately the same angle. In such a case, the free edges would be the upper edges of each individual louver.

From the foregoing, it will be appreciated that an inlet/exhaust structure made according to the invention provides a means whereby both the combustion air inlet and the exhaust gas outlet are in close proximity to each other to minimize or eliminate the possibility of a pressure differential across the inlet and the outlet from coming into an existence as a result of air currents, thereby preventing combustion inefficiencies as a result of back flow of exhaust gas or a surge of combustion air that can result from such pressure differentials. It will also be appreciated that the unique configuration of the lower compartment 56 in terms of having downwardly and inwardly slipping side walls provides a means to prevent the entry of, for example, rain water into the system. Moreover, the presence of the louvers 52,66 serves as a further means to prevent the entry of water into the system.

It will also be observed that by in effect "jacketing" the exhaust gas duct 26 with the combustion air inlet duct 66, inlet air may be somewhat warmed by the exhaust gas to recapture some of the heat in the exhaust gas stream, thereby improving combustion efficiency still further.

We claim:

1. In a heater intended for installation in an outdoor area and having a housing;

a combustion zone within said housing for burning fuel and generating gasses of combustion;

a plenum within said housing and having a heat exchanger for receiving said gasses of combustion and an air space for receiving air to be heated; and a combustion gas discharge opening, said plenum being spaced from said housing to define a combustion air receiving space; and ports in said housing including an exhaust port connected to said gas discharge opening and an inlet port in fluid communication with said combustion air receiving space; the improvement including:

an inlet/exhaust structure mounted on said housing and having an upper compartment separated from a lower compartment by a partition;

a first conduit connected to said exhaust port and extending through said lower compartment and said partition to said upper compartment;

a second conduit extending from said air inlet to said lower compartment;

said lower compartment having a side wall extending downwardly and inwardly; and vents in said side wall.

2. The heater of claim 1 wherein said ports are generally concentric with said exhaust port being within said air inlet port and said first conduit is located within said second conduit.

3. The heater of claim 1 wherein said vents include a series of generally horizontal extending louvers.

4. The heater of claim 1 wherein said louvers have lower free edges extending outwardly and away from said side walls.

5. The heater of claim 1 wherein said lower compartment is shaped as an inverted truncated pyramid.

6. The heater of claim 5 wherein said first conduit is cylindrical in cross section and said second conduit is a polygonal in cross section.

7. The heater of claim 6 wherein said first conduit is located within said second conduit.

8. An inlet/exhaust structure for mounting on a fuel consuming furnace having a housing containing a fuel combustion area and a heat exchanger associated therewith for receiving products of combustion and heating a fluid medium therewith, said housing having a combustion air inlet in fluid communication with said combustion area and an exhaust gas outlet in fluid communication with said heat exchanger, said inlet and said outlet being generally concentric with said outlet being within said inlet, said inlet/exhaust structure comprising:

a generally rectangular upper compartment having an imperforate upper wall, horizontally louvered, vertical side walls and an imperforate bottom wall with a generally central opening therein;

a lower compartment in the form of an inverted truncated pyramid with its upper wall being defined by said first compartment lower wall and having horizontally louvered, sloped, inwardly directed side walls terminating in an open bottom of smaller size than said first compartment lower wall;

a generally rectangular inlet air duct depending from the lower edges of said lower compartment side walls; and an exhaust duct within said inlet air duct and extending upwardly through said lower compartment to said generally central opening.

9. The inlet/exhaust structure of claim 8 wherein said horizontally louvered side walls have horizontally elongated louvers with lower free edges disposed outwardly of the associated side walls.

10. The inlet/exhaust structure of claim 9 wherein said exhaust duct is circular in cross section.

11. The inlet/exhaust structure of claim 10 wherein said lower compartment side walls are at least about 20° to the vertical.

12. The inlet/exhaust structure of claim 11 wherein the louvers in said lower compartment side walls are at about 45° to the associated side wall.

* * * * *